United States Patent [19]

Kitabatake et al.

[11] Patent Number: 5,023,161

[45] Date of Patent: Jun. 11, 1991

[54] METHOD OF MAKING A TONER FOR USE IN ELECTROPHOTOGRAPHY

[75] Inventors: Yasuo Kitabatake; Tadashi Nakamura; Yoshiaki Takahashi, all of Nara; Kazuya Maeda, Osaka, all of Japan

[73] Assignee: Sharp Kabushiki Kaisha, Osaka, Japan

[21] Appl. No.: 604,341

[22] Filed: Oct. 25, 1990

Related U.S. Application Data

[60] Continuation of Ser. No. 418,804, Oct. 4, 1989, abandoned, which is a continuation of Ser. No. 296,874, Jan. 12, 1989, abandoned, which is a division of Ser. No. 119,588, Nov. 12, 1987, abandoned.

[30] Foreign Application Priority Data

Nov. 21, 1986 [JP] Japan ..... 61-279257

[51] Int. Cl.[5] ..... G03G 9/093

[52] U.S. Cl. ..... 430/137; 430/138; 427/195

[58] Field of Search ..... 430/137, 138; 427/195

[56] References Cited

U.S. PATENT DOCUMENTS

| | | | |
|---|---|---|---|
| 3,854,975 | 12/1974 | Brenneman et al. | 430/98 |
| 4,740,443 | 4/1988 | Nakahara et al. | 430/110 X |
| 4,803,144 | 2/1989 | Hosoi | 430/138 X |
| 4,859,560 | 8/1989 | Nakamura et al. | 430/137 |

FOREIGN PATENT DOCUMENTS

| | | | |
|---|---|---|---|
| 1140784 | 2/1983 | Canada | 430/137 |
| 58-153950 | 9/1983 | Japan | 430/138 |

*Primary Examiner*—Roland Martin
*Attorney, Agent, or Firm*—Irell & Manella

[57] ABSTRACT

A toner for use in electrophotography comprises particles composed of an inner core containing a pigment and surrounded by an outer layer which contains a conductive substance to reduce its resistance but is free of pigments so as to improve the stability of its charging characteristics.

5 Claims, 2 Drawing Sheets

METHOD OF MAKING A TONER FOR USE IN ELECTROPHOTOGRAPHY

This is a continuation of application Ser. No. 418,804 filed Oct. 4, 1989, now abandoned, which is a continuation of application Ser. No. 296,874 filed Jan. 12, 1989 and now abandoned, which is a divisional of application Ser. No. 119,588 filed Nov. 12, 1987 and now abandoned.

BACKGROUND OF THE INVENTION

This invention relates to a toner for use as a developing agent in an electrophotographic copier and the like and more particularly to a method of producing such a toner.

Electrophotographic copiers and the like generally use a two-component developing agent including a toner and a carrier. The toner is produced by mixing a resin material, a coloring agent such as an organic pigment and a charge controlling agent and stirring (or kneading) them together. Many kinds of organic pigments in many forms can be utilized and toners of many different colors can be produced by selecting a proper organic pigment.

It is important that the toner have uniform charging characteristics because they significantly affect the manner in which the toner particles become attached to a photosensitive body and hence the quality of the image which is eventually formed. The charging characteristics of a toner vary, however, depending significantly upon the composition of the pigment on the surface. In Japanese patent Application 61-172440 entitled (in translation) "Toner For Use In Electrophotography", the present applicants disclosed a toner which contains a pigment only in the interior section and of which the exterior layer contains a charge controlling agent dispersed therethrough such that the use of a different pigment would not affect the charging characteristics of the toner and hence that the problem mentioned above is eliminated.

With the toner described above, the charging characteristics are successfully stabilized but since its main component is a resin material and since resins have a high electrical resistance, the toner tends to become charged excessively in spite of the charge controlling agent which is also mixed together. A proper level of charging cannot be attained with such a toner. Because of this high electrical resistance, furthermore, a toner of this type requires an excessively long time for charging inside a developing tank.

SUMMARY OF THE INVENTION

It is therefore an object of the present invention to provide an improved toner for use in electrophotography which not only has stable charging characteristics and hence can be charged to an optimum level but can also be charged in a reduced length of time.

The above and other objects of the present invention are achieved by providing a toner with particles having an inner core covered by an outer layer which contains an electroconductive substance without containing any pigment.

Toner particles become charged by friction as they are stirred inside a developing tank. The level of charging and its stability characteristics depend almost entirely on the outer layer of the toner particles. Thus, the level of charging can be optimally controlled if the electrical resistance of this layer can be properly controlled and the charging characteristics are stabilized if the outer layers of toners have the same composition.

According to the present invention, the charging level can be optimally controlled because an electrically conductive substance is contained in the outer layer and hence its resistance is reduced. Since the outer layer does not contain any pigment, furthermore, pigments do not affect the level of charging and hence the charging characteristics can be stabilized among the toners of different colors. Since the outer layer has reduced resistance, the time required for charging the toner is also reduced.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1B:
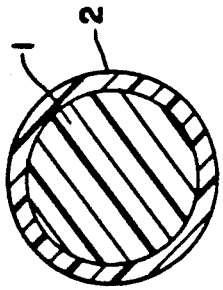
FIG. 1B is a schematic sectional view of a toner particle embodying the present invention.

With reference to FIG. 1B, a toner according to the present invention comprises particles composed of an inner core 1 which does not contain any charge controlling agent or conductive substance and an outer layer 2 which contains a charge controlling agent and a conductive substance and surrounds the inner core 1. The inner core 1 contains a pigment but the outer layer 2 does not contain any pigment.

Figure 2:
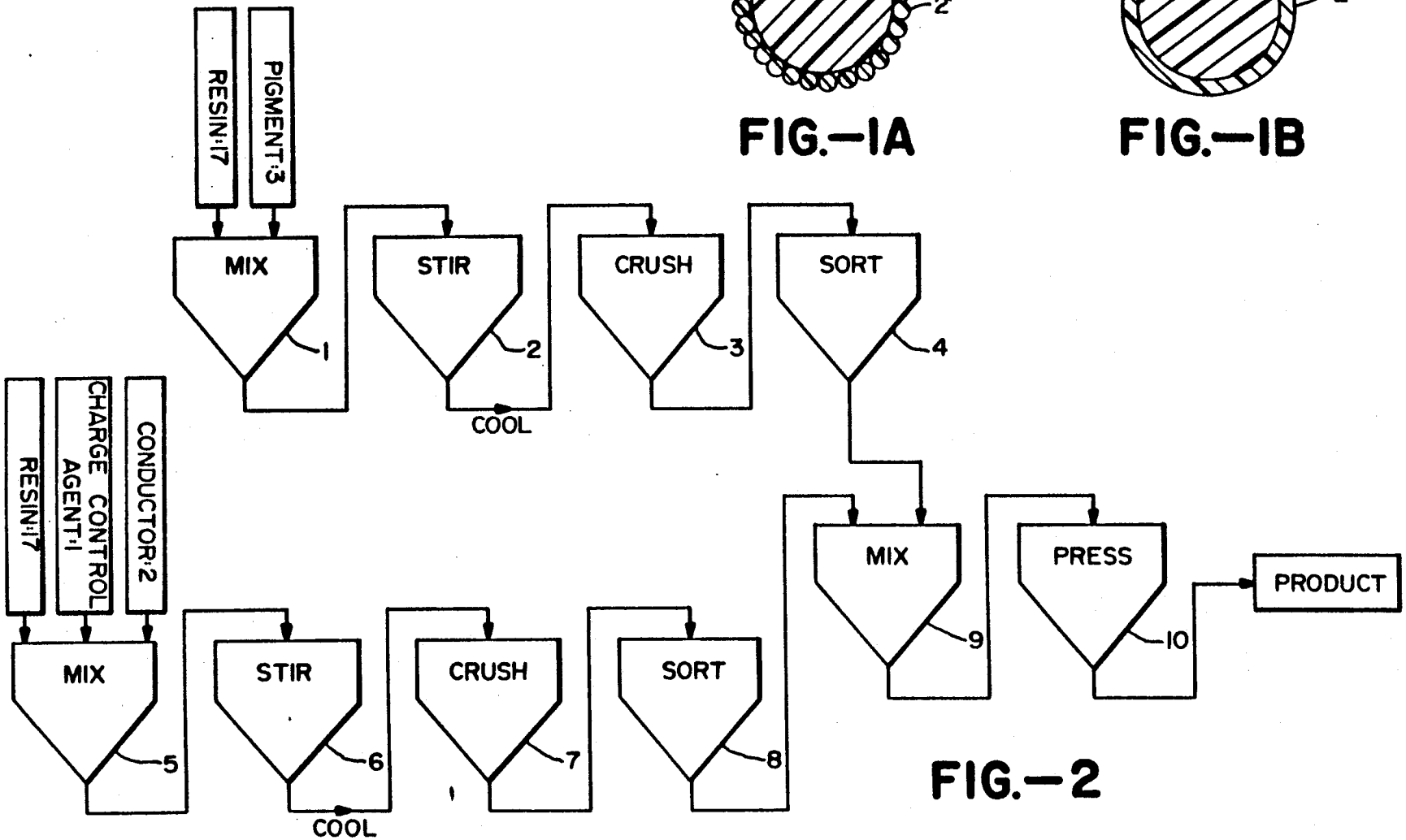
FIG. 2 is a block diagram of the production process of a toner of the present invention.

As shown in FIG. 2, the toner of the present invention shown in FIG. 1B is produced by independently preparing inner core particles from which the inner cores are formed and outer layer particles from which the outer layers are formed and then mixing them together and applying heat or pressure to them to attach the outer layer particles around inner core particle. The inner core particles contain a resin material and a pigment but are free of any charge controlling agent and conductive substance. The outer layer particles, on the other hand, contain a resin material, a charge controlling agent and a conductive substance but are free of any pigment.

According to a demonstrative example of the present invention, two types of inner core particles were produced with a black organic pigment and a red organic pigment. Use was also made of quaternary ammonium salt as charge controlling agent and of a conductive material such as metal oxides as conductive substance.

With reference to FIG. 2, numerals 1–4 indicate steps by which inner core particles are produced. To start, a resin material and a pigment are mixed together at weight ratio of 17:3 and a heating roller is used in the next step to melt or otherwise soften this mixture and to stir them uniformly. When this mixture returns to normal temperature, a hammer mill or a jet mill is used to crush the mixture into particles of about 8 μm in diameter (in Step 3). Rough and fine particles are removed thereafter in Step 4, and inner core particles of average diameter about 8 μm are obtained. A different set of apparatus for these processes is used for each type of pigment.

Outer layer particles are prepared in Steps 5, 6, 7 and 8 in parallel with the processes described above. In the first of these steps (Step 5 in FIG. 2), a resin material, a charge controlling agent and a conductive substance are mixed together at weight ratio of 17:1:2 and they are stirred, crushed and sorted as in Steps 2, 3 and 4 described above except the crushing step 7 is carried out such that the average size of the particles will become about 1 μm. A single set of apparatus may be used for forming outer layer particles of all toners with different colors.

Figure 1A:
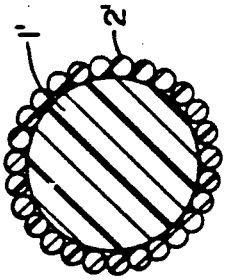
FIG. 1A is a schematic sectional view of a toner particle embodying the present invention during its production process.

In Step 9, the inner core particles and outer layer particles thus formed are mixed together at weight ratio of 1:1 such that smaller outer layer particles are attached around each of the bigger inner core particles. FIG. 1A is a sectional view of an inner core particle 1' thus surrounded by a number of outer layer particles 2' at the end of Step 9. In Step 10, a pressure is applied to the mixture but only to an extent that the inner core particles 1' and outer layer particles 2' are not crushed but that the outer layer particles 2' become compressed over the outer surfaces of the inner core particles 1' to produce toner particles as shown in FIG. 1B. Separate apparatus are used for Steps 9 and 10, corresponding to each kind of pigment used in the inner core particles. Alternatively to Step 10 described above, heat may be applied to attach the outer layer particles 2' around the inner core particles 1' by melting.

Figure 3:
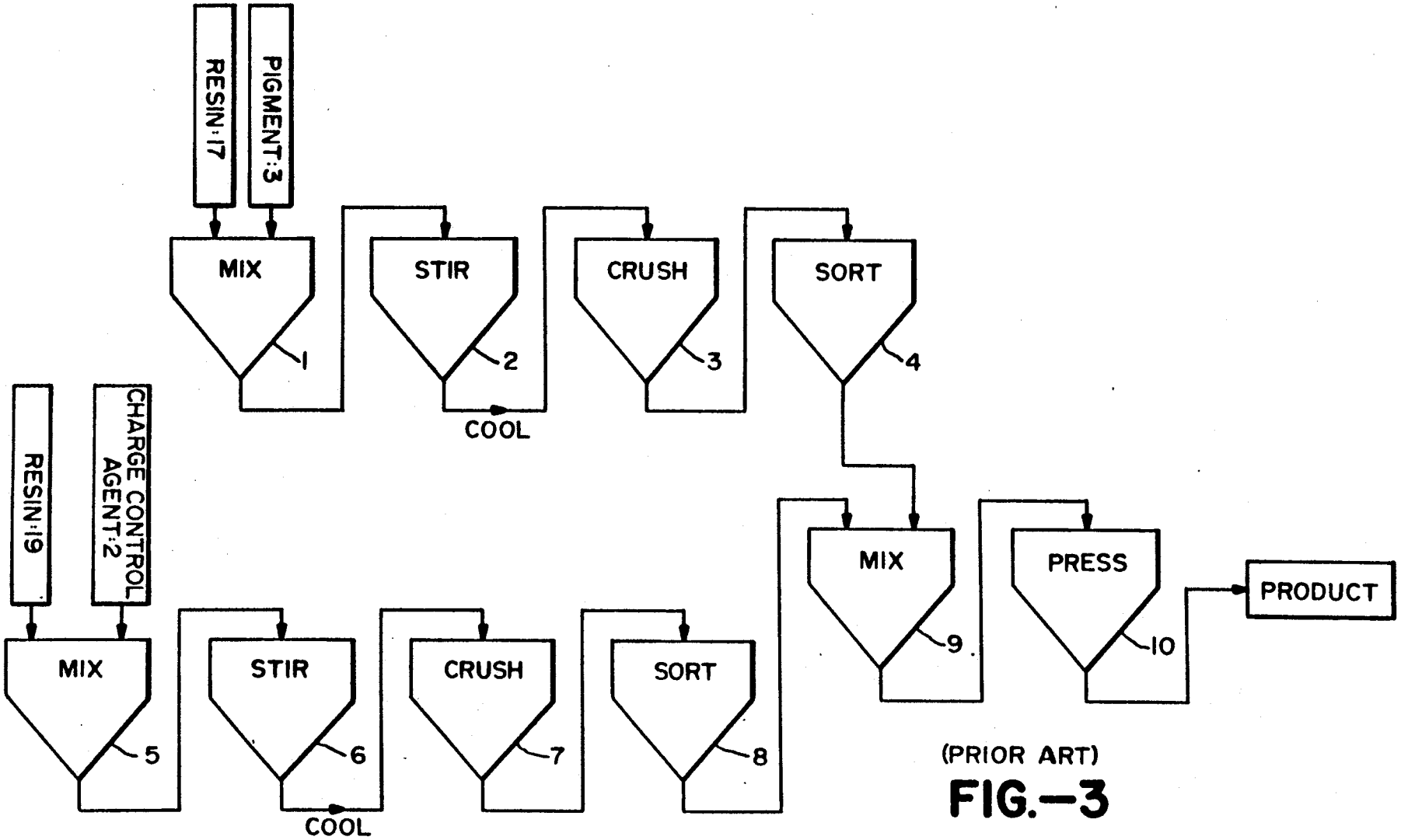
(PRIOR ART) FIG.—3
FIG. 3 is a block diagram of a conventional toner production process.

As mentioned above, a black toner and a red toner were obtained by the method described above by way of FIG. 2. For comparison, another black toner and another red toner were formed by a conventional method which, as shown in FIG. 3, is identical to the method of the present invention described above by way of FIG. 2 except no conductive substance is used in Steps 5, 6, 7 and 8, and the charge and the time required for charging were measured with each of these four toners. As for the charge, the toners of the present invention (both black and red) showed good results in the range of 10–20 μC/g but the measured values were excessively high and the distribution was broad with the toners obtained by the conventional method of FIG. 3. It was also observed that the time required for charging was longer for the toners produced by the conventional method than for those produced by the method of the present invention. The results were nearly the same between the black and red toners produced by the method of the present invention, indicating that the pigments have no effect on the charge or the charging time and that the charging characteristics of the toner are stabilized according to the present invention. Another advantage of the present invention is that the inner cores do not contain any charge controlling agent or conductive substance and hence charge controlling agent and conductive substance need not be used wastefully. This has the desirable consequence of reducing the production cost of the toner.

The foregoing description of a preferred embodiment of the invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. A method of producing a toner for use in electrophotography comprising the steps of heating to melt or soften and uniformly kneading a first mixture which includes a resin and a colorant mixed together and is substantially free of both charge controlling agents and conductive materials to thereby obtain a first kneaded substance which is substantially free of both charge controlling agents and conductive materials, obtaining core particles which are substantially free of both charge controlling agents and conductive materials by crushing and sorting said first kneaded substance after said first kneaded substance is cooled to a normal temperature, heating to melt or soften and uniformly kneading a second mixture which includes a resin, a charge controlling agent and a conductive material mixed together and is substantially free of colorants to thereby obtain a second kneaded substance which is substantially free of colorants, obtaining outer particles which are substantially free of colorants and have smaller granular diameters than said core particles by crushing and sorting said second kneaded substance after said second kneaded substance is cooled to a normal temperature, mixing approximately same weights of said outer particles and said core particles together to cause said outer particles to adhere to surfaces of said core particles, and applying a pressure such that said outer and core particles are not crushed but that said outer particles form over said surfaces of said core particles an outer layer which is substantially free of colorants.

2. The method of claim 1 wherein said core particles are about 8 μm in diameter.

3. The method of claim 1 wherein said charge controlling agent comprises quaternary ammonium salt.

4. The method of claim 1 wherein said conductive substance comprises a metal oxide.

5. The method of claim 1 wherein the granular diameter of said outer particles is about 1 μm.

* * * * *